US008298069B2

(12) United States Patent
Gowin

(10) Patent No.: US 8,298,069 B2
(45) Date of Patent: Oct. 30, 2012

(54) GAMING MACHINE REEL ALIGNMENT

(75) Inventor: Scott Timothy Gowin, Reno, NV (US)

(73) Assignee: IGT, Reno, NV (US)

( * ) Notice: Subject to any disclaimer, the term of this patent is extended or adjusted under 35 U.S.C. 154(b) by 677 days.

(21) Appl. No.: 12/463,989

(22) Filed: May 11, 2009

(65) Prior Publication Data

US 2010/0285861 A1 Nov. 11, 2010

(51) Int. Cl.
*A63F 9/24* (2006.01)

(52) U.S. Cl. ..... 463/20

(58) Field of Classification Search ..... 463/20, 463/30

See application file for complete search history.

(56) References Cited

U.S. PATENT DOCUMENTS

| | | | | |
|---|---|---|---|---|
| 6,149,522 | A | 11/2000 | Alcorn et al. | |
| 6,685,567 | B2 | 2/2004 | Cockerille et al. | |
| 6,804,763 | B1 | 10/2004 | Stockdale et al. | |
| 6,863,608 | B1 | 3/2005 | LeMay et al. | |
| 6,942,571 | B1 | 9/2005 | McAllister et al. | |
| 7,360,761 | B2 | 4/2008 | Durham et al. | |
| 7,419,428 | B2 | 9/2008 | Rowe | |
| 7,515,718 | B2 | 4/2009 | Nguyen et al. | |
| 2005/0192085 | A1 * | 9/2005 | Iwamoto | 463/20 |
| 2006/0199638 | A1 * | 9/2006 | Walker et al. | 463/30 |
| 2007/0060323 | A1 | 3/2007 | Isaac et al. | |

* cited by examiner

*Primary Examiner* — Bradley K Smith

(74) *Attorney, Agent, or Firm* — Weaver Austin Villeneuve & Sampson LLP

(57) ABSTRACT

An electromechanical wager-based gaming machine includes a plurality of reels that are aligned as they are spun so that the reels can be rapidly stopped in response to a player's input. One reel is selected as a reference reel and other reels are brought into alignment using feedback from reel position sensors.

17 Claims, 7 Drawing Sheets

GAMING MACHINE REEL ALIGNMENT

TECHNICAL FIELD

The present invention relates generally to gaming devices and systems, and more specifically to wager-based gaming machines having spinning reels.

BACKGROUND

Casinos and other forms of gaming comprise a growing multi-billion dollar industry both domestically and abroad, with electronic and microprocessor based gaming machines being more popular than ever. A gaming entity that provides gaming services may control gaming devices that are globally distributed in many different types of establishments. For example, gaming machines may be placed in casinos, convenience stores, racetracks, supermarkets, bars and boats. Further, via a remote server, a gaming entity may provide gaming services in a locale of a user's choosing, such as on a home computer or on a mobile device carried by the user.

Electronic, electromechanical, and microprocessor based gaming machines can include various hardware and software components to provide a wide variety of game types and game playing capabilities, with such hardware and software components being generally well known in the art. For example, bill validators, coin acceptors, card readers, keypads, buttons, levers, touch screens, displays, coin hoppers, player tracking units and the like are examples of hardware that can be coupled to a gaming machine. Software components can include, for example, boot and initialization routines, various game play programs and subroutines, credit and payout routines, image and audio generation programs, security monitoring programs, authentication programs and a random number generator, among others.

The functions available on a gaming machine may depend on whether the gaming machine is linked to other gaming devices. For instance, when connected to other remote gaming devices, a gaming machine may provide progressive jackpots, player tracking and loyalty points programs, cashless gaming, and bonusing among other items. Many of these added components, features and programs can involve the implementation of various back-end and/or networked systems, including more hardware and software elements, as is generally known.

In a typical casino-based electronic gaming machine, such as a slot machine, video poker machine, video keno machine or the like, a game play is initiated through a wager of money or credit, whereupon the gaming machine determines a game outcome, presents the game outcome to the player and then potentially dispenses an award of some type, including a monetary award, depending upon the game outcome. In this instance, the gaming machine is operable to receive, store and dispense indicia of credit or cash as well as calculate a gaming outcome that could result in a large monetary award. The gaming machine is enabled to operate in this manner because it is placed typically in a location that is monitored (e.g., a casino), the gaming machine hardware and software components are secured within a locked cabinet and the gaming machine includes a security system for detecting fraud or theft attempts.

Various systems are used to present a game outcome to a player. Electronic video displays in combination with audio devices and other electronic elements are used in some systems. Other systems use spinning reels to display a game outcome to a player. Historically, wager-based gaming machines used spinning reels that were set in motion by a player pulling a lever on the side of the machine. Such purely mechanical machines were later replaced by electromechanical machines in which reels are spun by electric motors (typically stepper motors), and stopped so that they display a predetermined game outcome. Newer generations of wager-based gaming machines are purely electronic, without any spinning reels or other moving parts, and with video displays that present a video representation of gaming activity (which may include video representation of spinning reels). Electromechanical machines have an appeal to some players who are accustomed to spinning reels and do not like purely electronic displays. Such electromechanical systems therefore remain in production and in use, and are expected to remain in use for some time to come. Providing improved functionality in such mechanical systems is therefore desirable.

SUMMARY

Aspects of the present invention are directed to aligning spinning reels in an electromechanical wager-based gaming machine. For example, where a game outcome is displayed by the final positions of spinning reels, the reels may be aligned as they spin so that they are ready to be stopped rapidly if a player wants to see the game outcome without waiting the normal period of time. The player may provide an input that indicates that reels should be stopped, for example by pressing the play button a second time after reels have started spinning but before the normal stopping time. Generally, such an input (known as "reel slamming") provides faster play which is attractive to players and can provide greater revenue for a machine owner.

In an embodiment, reels are brought into alignment by choosing a reel as the reference reel (master reel, or alpha reel) and using its position as a reference to bring other reels (subordinate reels) into alignment. Sensors monitor positions of reels as they spin and provide feedback to a reel controller system which can adjust speeds of reels as they spin. Once reels are aligned, all reels can be stopped rapidly because no further alignment is needed. Alignment may mean that all reels are in relative positions that correspond to their final positions so that all reels may be stopped simultaneously. Alternatively alignment may mean that reels are arranged to stop in a stopping sequence where individual reels stop at different times. Reels may stop in a pattern that is chosen by a player, or a random pattern, so that game outcome is presented in a manner that is pleasing to a player and maintains a player's interest.

In an embodiment, a method of controlling a plurality of reels of a mechanical wager-based gaming machine includes: determining a distance between present reel position and final reel position for each of the plurality of reels; selecting a reference reel from among the plurality of reels; determining an offset between the final reel position of the reference reel and the final reel position of each other reel; spinning the plurality of reels, the reference reel spun according to a predetermined profile, the predetermined profile selected to stop the selected reel at its final position; sensing positions of each of the plurality of reels during spinning; and adjusting reel speeds of each of the other reels relative to the reference reel to align the other reels with the reference reel according to their determined offsets from the reference reel.

A mechanical wager-based gaming machine according to an embodiment of the present invention includes: a plurality of reels, including a reference reel and subordinate reels, that are rotated by a plurality of motors; a plurality of sensors that sense positions of reels as the reels are rotated; and a motor control system that receives inputs from the plurality of sensors and provides outputs that control the plurality of motors to align subordinate reels with the reference reel by adjusting speeds of the subordinate reels according to position differences between the subordinate reels and the reference reel as indicated by the plurality of position sensors.

BRIEF DESCRIPTION OF THE DRAWINGS

The included drawings are for illustrative purposes and serve only to provide examples of possible structures and process steps for the disclosed inventive systems and methods for providing a customizable interface and remote management of content on a gaming machine. These drawings in no way limit any changes in form and detail that may be made to the invention by one skilled in the art without departing from the spirit and scope of the present invention.

DETAILED DESCRIPTION

Figure 1A:
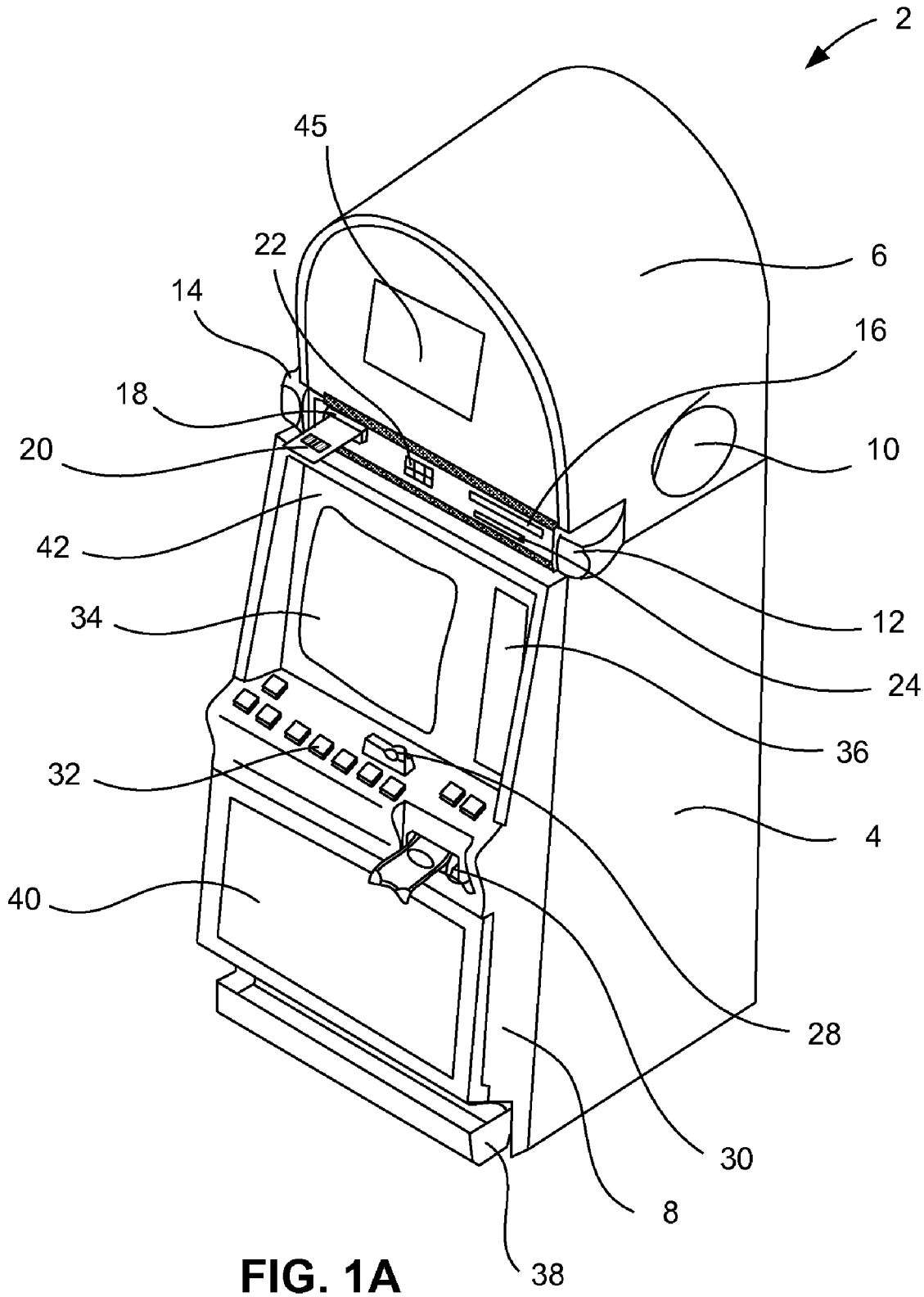
FIG. 1A shows an example of an electromechanical wager-based gaming machine according to an embodiment of the present invention.

FIG. 1A shows a perspective view of an electromechanical gaming machine 2 in accordance with a specific embodiment of the present invention. The gaming devices may be operated in accordance with instructions received from a remote host in communication with the gaming machine. In some instances, a host-controlled process executed on the gaming machine may share a gaming device with a process controlled by the master gaming controller on the gaming machine.

As illustrated in the example of FIG. 1A, machine 2 includes a main cabinet 4, which generally surrounds the machine interior and is viewable by users. The main cabinet includes a main door 8 on the front of the machine, which opens to provide access to the interior of the machine.

In one embodiment, attached to the main door are at least one payment acceptor 28 and a bill validator 30, and a coin tray 38. In one embodiment, the payment acceptor may include a coin slot and a payment, note or bill acceptor, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming machine. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming machine. In one embodiment, money may be transferred to a gaming machine through electronic funds transfer. When a player funds the gaming machine, the master gaming controller or another logic device coupled to the gaming machine determines the amount of funds entered and displays the corresponding amount on the credit or other suitable display as described above.

In one embodiment attached to the main door is a plurality of player-input switches or buttons 32. The input switches can include any suitable devices which enables the player to produce an input signal which is received by the processor. In one embodiment, after appropriate funding of the gaming machine, the input switch is a game activation device, such as a pull arm or a play button which is used by the player to start any primary game or sequence of events in the gaming machine. The play button can be any suitable play activator such as a bet one button, a max bet button or a repeat the bet button. In one embodiment, upon appropriate funding, the gaming machine may begin the game play automatically. In another embodiment, upon the player engaging one of the play buttons, the gaming machine may automatically activate game play.

In one embodiment, one input switch is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input switch is a bet max button (not shown), which enables the player to bet the maximum wager permitted for a game of the gaming machine.

In one embodiment, one input switch is a cash-out button. The player may push the cash-out button and cash out to receive a cash payment or other suitable form of payment corresponding to the number of remaining credits. In one embodiment, when the player cashes out, the player may receive the coins or tokens in a coin payout tray. In one embodiment, when the player cashes out, the player may receive other payout mechanisms such as tickets or credit slips redeemable by a cashier (or other suitable redemption system) or funding to the player's electronically recordable identification card. Details of ticketing or voucher system that may be utilized with the present invention are described in co-pending U.S. patent application Ser. No. 10/406,911, filed Apr. 2, 2003, by Rowe, et al., and entitled, "Cashless Transaction Clearinghouse," which is incorporated herein by reference and for all purposes.

In one embodiment, one input switch is a touch-screen coupled with a touch-screen controller, or some other touch-sensitive display overlay to enable for player interaction with the images on the display. The touch-screen and the touch-screen controller may be connected to a controller. A player may make decisions and input signals into the gaming machine by touching the touch-screen at the appropriate places. One such input switch is a touch-screen button panel.

In one embodiment, the gaming machine may further include a plurality of communication ports for enabling communication of the gaming machine processor with external peripherals, such as external video sources, expansion buses, game or other displays, an SCSI port or a key pad.

The information panel 36 or belly-glass 40 may be a static back-lit, silk screened glass panel with lettering to indicate general game information including, for example, a game denomination (e.g. $0.25 or $1) or a dynamic display, such as an LCD, an OLED or E-INK display.

In the embodiment of FIG. 1A, the symbols, images and indicia displayed by display device 34 are in electromechanical form. That is, the display device 34 includes multiple rotatable reels configured to display a plurality of game images or other suitable images, symbols or indicia. In particular, display device 34 provides a player with a view of reels as they are spun and subsequently stopped at positions that show a game outcome (e.g. along one or more paylines). In another embodiment, a display device may include an electromechanical device adjacent to a video display, such as a video display positioned in front of a mechanical reel.

The bill validator 30, player-input switches 32, display device 34, and information panel are gaming devices that may be used to play a game on the game machine 2. Also, these devices may be utilized as part of an ECI provided on the gaming machine. According to a specific embodiment, the devices may be controlled by code executed by a master gaming controller housed inside the main cabinet 4 of the machine 2. The master gaming controller may include one or more processors including general purpose and specialized processors, such as graphics cards, and one or more memory devices including volatile and non-volatile memory. The master gaming controller 46 may periodically configure and/or authenticate the code executed on the gaming machine.

In one embodiment, the gaming machine may include a sound generating device coupled to one or more sounds cards. In one embodiment, the sound generating device includes at least one and preferably a plurality of speakers or other sound generating hardware and/or software for generating sounds, such as playing music for the primary and/or secondary game or for other modes of the gaming machine, such as an attract mode. In one embodiment, the gaming machine provides dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In one embodiment, the gaming machine may include a sensor, such as a camera that is selectively positioned to acquire an image of a player actively using the gaming machine and/or the surrounding area of the gaming machine. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In another embodiment, the gaming devices on the gaming machine may be controlled by code executed by the master gaming controller (or another logic device coupled to or in communication with the gaming machine, such as a player tracking controller) in conjunction with code executed by a remote logic device in communication with the master gaming controller.

As illustrated in the example of FIG. 1A, the gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a display 16 (e.g., a video LCD display) for displaying player tracking information, a card reader 24 for entering a magnetic striped card containing player tracking information, and a video display screen 45. The ticket printer 18 may be used to print tickets for a cashless ticketing system. Further, the top box 6 may house different or additional devices not illustrated in FIG. 1A. For example, the top box may include a bonus wheel or a back-lit silk screened panel which may be used to add bonus features to the game being played on the gaming machine. As another example, the top box may include a display for a progressive jackpot offered on the gaming machine. During a game, these devices are controlled and powered, in part, by circuitry (e.g. a master gaming controller) housed within the main cabinet 4 of the machine 2.

It will be appreciated that gaming machine 2 is but one example from a wide range of gaming machine designs on which the present invention may be implemented. For example, not all suitable gaming machines have top boxes or player tracking features. Further, some gaming machines have only a single game display—mechanical or video, while others may have multiple displays.

Networks

In various embodiments, the remote gaming device may be connected to the host computer via a network of some type such as a local area network, a wide area network, an intranet or the Internet. In one such embodiment, a plurality of the gaming machines may be capable of being connected together through a data network. In one embodiment, the data network is a local area network (LAN), in which one or more of the gaming machines are substantially proximate to each other and an on-site remote host as in, for example, a gaming establishment or a portion of a gaming establishment. In another embodiment, the data network is a wide area network (WAN) in which one or more of the gaming machines are in communication with at least one off-site remote host. In this embodiment, the plurality of gaming machines may be located in a different part of the gaming establishment or within a different gaming establishment than the off-site remote host. Thus, the WAN may include an off-site remote host and an off-site gaming machine located within gaming establishments in the same geographic area, such as a city or state. The WAN gaming system may be substantially identical to the LAN gaming system described above, although the number of gaming machines in each system may vary relative to each other.

Gaming Machine vs. General-Purpose Computer

The gaming machine of FIG. 1A uses electromechanical reels to display a game outcome to a player. This is clearly different to a general-purpose computer which uses an electronic display without moving parts. In addition to this obvious difference there are other features of gaming machines which clearly distinguish gaming machines (including gaming machines with video or electromechanical displays) from general-purpose computers. Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer is normally used in International Game Technology (IGT) gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that enables the first state to be reconstructed is stored. This feature enables the game to recover operation to the current state of play in the event of a malfunction, loss of power, etc that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion. Further details of a state based gaming system, recovery from malfunctions and game history are described in U.S. Pat. No. 6,804,763, titled "High Performance Battery Backed RAM Interface", U.S. Pat. No. 6,863,608, titled "Frame Capture of Actual Game Play," U.S. application Ser. No. 10/243,104, titled, "Dynamic NV-RAM," and U.S. application Ser. No. 10/758,828, titled, "Frame Capture of Actual Game Play," each of which is incorporated by reference and for all purposes.

A feature of gaming machines, such as IGT gaming computers, is that they often include unique interfaces, including serial interfaces, to connect to specific subsystems internal and external to the gaming machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the gaming machine, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming machine to a remote device. Often SAS is used in conjunction with a player tracking system.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, e.g., via software for reading status registers.

This can trigger event log entries and further data authentication operations by the gaming machine software.

Trusted memory devices and/or trusted memory sources are preferably included in an IGT gaming machine computer to ensure the authenticity of the software that may be stored on less secure memory subsystems, such as mass storage devices. Trusted memory devices and controlling circuitry are typically designed to not enable modification of the code and data stored in the memory device while the memory device is installed in the gaming machine. The code and data stored in these devices may include authentication algorithms, random number generators, authentication keys, operating system kernels, etc. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of the verification algorithms included in the trusted device, the gaming machine is enabled to verify the authenticity of additional code and data that may be located in the gaming computer assembly, such as code and data stored on hard disk drives. A few details related to trusted memory devices that may be used in the present invention are described in U.S. Pat. No. 6,685,567 from U.S. patent application Ser. No. 09/925,098, filed Aug. 8, 2001 and titled "Process Verification," which is incorporated herein in its entirety and for all purposes.

In at least one embodiment, at least a portion of the trusted memory devices/sources may correspond to memory which cannot easily be altered (e.g., "unalterable memory") such as, for example, EPROMS, PROMS, Bios, Extended Bios, and/or other memory sources which are able to be configured, verified, and/or authenticated (e.g., for authenticity) in a secure and controlled manner.

According to a specific implementation, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment of the present invention, the remote device and the trusted information source may engage in methods using zero knowledge proofs to authenticate each of their respective identities.

Gaming devices storing trusted information may utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

Additional details relating to trusted memory devices/sources are described in U.S. patent application Ser. No. 11/078,966, entitled "Secured Virtual Network in a Gaming Environment", naming Nguyen et al. as inventors, filed on Mar. 10, 2005, herein incorporated in its entirety and for all purposes.

Mass storage devices used in a general purpose computer typically enable code and data to be read from and written to the mass storage device. In a gaming machine environment, modification of the gaming code stored on a mass storage device is strictly controlled and would only be enabled under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. Details using a mass storage device that may be used with the present invention are described, for example, in U.S. Pat. No. 6,149,522, herein incorporated by reference in its entirety for all purposes.

Game Play

Returning to the example of FIG. 1A, when a user wishes to play the gaming machine 2, he or she inserts a ticket or cash through the payment or coin acceptor 28 or bill validator 30. Additionally, the bill validator may accept a printed ticket voucher, which may be accepted by the bill validator 30 as indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using display 34. Other game and prize information may also be displayed in the video display screen 45 located in the top box.

During the course of a game, a player may be required to make a number of decisions, which affect the outcome of the game. For example, a player may vary his or her wager on a particular game, select a number of paylines to bet on, or make game decisions which affect the outcome of a particular game. The player may make these choices using the player-input switches 32, the display 34 or using some other device which enables a player to input information into the gaming machine. In some embodiments, the player may be able to access various game services such as concierge services and entertainment content services using the display 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

In one embodiment, as described above, the gaming machine can incorporate any suitable reel-based wagering primary or base game. The primary or base game may comprise any suitable reel-type game susceptible to representation in an electromechanical form, which in one embodiment produces a random outcome based on probability data at the time of or after placement of a wager.

In one embodiment, a base or primary game may be a slot game with one or more paylines. The paylines may be horizontal, vertical, circular, diagonal, angled or any combination thereof. In this embodiment, the gaming machine includes a plurality of reels, such as three to five reels, in electromechanical form with mechanical rotating reels. In one embodiment, an electromechanical slot machine includes a plurality of adjacent, rotatable reels, which may be combined and operably coupled with an electronic display of any suitable type. Each reel displays a plurality of indicia or symbols, such as bells, hearts, fruits, numbers, letters, bars or other images, which preferably correspond to a theme associated with the gaming machine. In another embodiment, one or more of the reels are independent reels or unisymbol reels. In this embodiment, each independent or unisymbol reel generates and displays one symbol to the player. In one embodiment, the gaming machine awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming machine determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming machine provides the player one award for that occurrence of the generated winning symbol combination. For example, if one winning symbol combination is generated on the reels, the gaming machine will provide a single award to the player for that winning symbol combination (i.e., not based on paylines that would have passed through that winning symbol combination). It should be appreciated that because a gaming machine with wagering on ways to win provides the player one award for a single occurrence of a winning symbol combination and a gaming machine with paylines may provide the player more than one award for the same occurrence of a single winning symbol combination (i.e., if a plurality of paylines each pass through the same winning symbol combination), it is possible to provide a player with more ways to win for an equivalent bet or wager on a traditional slot gaming machine with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming machine with at least one symbol generated in an active symbol position. For example, a three reel gaming machine with three symbols generated in active symbol positions on each reel includes 27 ways to win (i.e., 3 symbols on the first reel×3 symbols on the second reel×3 symbols on the third reel). A four reel gaming machine with three symbols generated in active symbol positions on each reel includes 81 ways to win (i.e., 3 symbols on the first reel×3 symbols on the second reel×3 symbols on the third reel×3 symbols on the fourth reel). A five reel gaming machine with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming machine may enable a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming machine uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming machine provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming machine provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming machine individually determines if a symbol generated in an active symbol position on a first reel forms part of a winning symbol combination with or is otherwise suitably related to a symbol generated in an active symbol position on a second reel. In this embodiment, the gaming machine classifies each pair of symbols, which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming machine classifies the two cherry symbols as a string of related symbols because the two cherry symbols form part of a winning symbol combination.

After determining if any strings of related symbols are formed between the symbols on the first reel and the symbols on the second reel, the gaming machine determines if any of the symbols from the next adjacent reel should be added to any of the formed strings of related symbols. In this embodiment, for a first of the classified strings of related symbols, the gaming machine determines if any of the symbols generated by the next adjacent reel form part of a winning symbol combination or are otherwise related to the symbols of the first string of related symbols. If the gaming machine determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming machine adds the related cherry symbol generated on the third reel to the previously classified string of cherry symbols.

On the other hand, if the gaming machine determines that no symbols generated on the next adjacent reel are related to the symbols of the first string of related symbols, the gaming machine marks or flags such string of related symbols as complete. For example, if the first string of related symbols is the string of related cherry symbols and none of the symbols of the third reel are related to the cherry symbols of the previously classified string of cherry symbols, the gaming machine marks or flags the string of cherry symbols as complete.

After either adding a related symbol to the first string of related symbols or marking the first string of related symbols as complete, the gaming machine proceeds as described above for each of the remaining classified strings of related symbols which were previously classified or formed from related symbols on the first and second reels.

After analyzing each of the remaining strings of related symbols, the gaming machine determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming machine marks each of the remaining pending strings of related symbols as complete.

When each of the strings of related symbols is marked complete, the gaming machine compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, in addition to winning credits or other awards in a base or primary game, as described above, the gaming machine may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game. In other embodiments, the triggering event or qualifying condition may be by exceeding a certain amount of game play (such as number of games, number of credits, amount of time), or reaching a specified number of points earned during game play.

In another embodiment, the gaming machine processor or remote host randomly provides the player one or more plays of one or more secondary games. In one such embodiment, the gaming machine does not provide any apparent reasons to the player for qualifying to play a secondary or bonus game. In this embodiment, qualifying for a bonus game is not triggered by an event in or based specifically on any of the plays of any primary game. That is, the gaming machine may simply qualify a player to play a secondary game without any explanation or alternatively with simple explanations. In another embodiment, the gaming machine (or remote host) qualifies a player for a secondary game at least partially based on a game triggered or symbol triggered event, such as at least partially based on the play of a primary game.

In one embodiment, the gaming machine includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 1B:
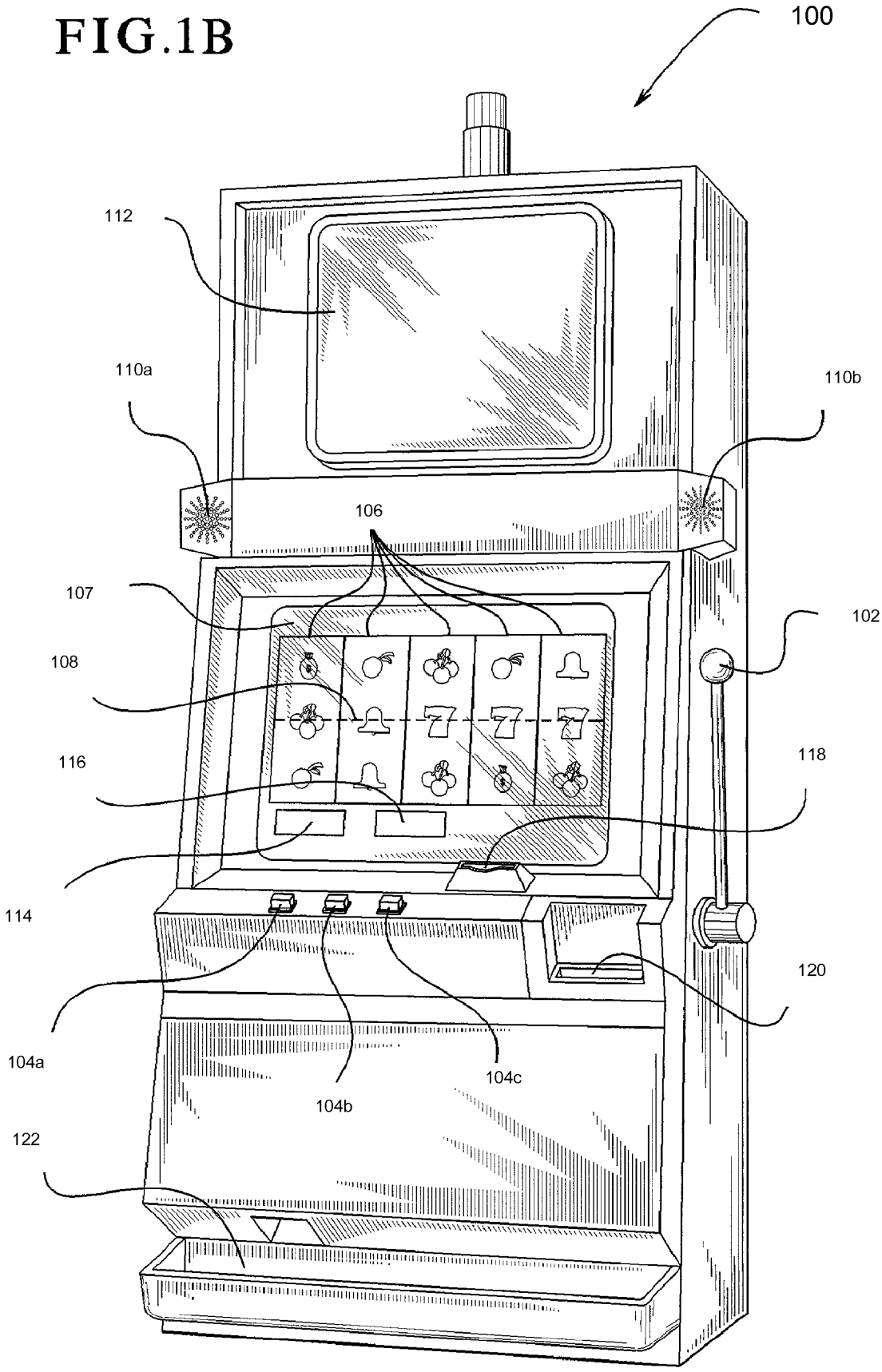
FIG. 1B shows an alternative electromechanical wager-based gaming machine.

FIG. 1B shows another electromechanical wager-based gaming machine 100. FIG. 1B shows a pull arm (lever or handle) 102 on the side of the gaming machine. The pull arm 102 may be used by a player to initiate play by pulling down on it. While older, purely mechanical gaming machines coupled such pull arms to reels, and used the player's actions to spin the reels, an electromechanical machine such as shown in FIG. 1B detects the movement of the lever electronically and has a separate mechanism for spinning reels. Thus, the pull arm 102 is used as another input switch in this arrangement. In addition to initiating reel spinning using the lever, spinning may generally be initiated using one or more of the buttons 104*a-c* on the front of the machine. FIG. 1B shows five separate reels 106 in the display 107. One payline 108 is illustrated, although as previously discussed, multiple paylines may be used including horizontal and diagonal paylines. Also shown are speakers 110*a*, 110*b*, a video display screen 112, credit display 114, bet display 116, player input buttons 104*a-c*, coin acceptor, bill validator 120, and a coin tray 122.

The reels 106 of the gaming machine 100 of FIG. 1B are spun so that a game outcome is presented to the user in the display 107. This game outcome is generally determined when play is initiated, for example when a player pulls the lever 102. The subsequent spinning and stopping of reels is a matter of display, rather than a process that actually determines the game outcome. Apart from the electromechanical display, an electromechanical wager-based gaming machine may operate like an all-electronic video gaming machine, with similar networking, security features, and game-related features.

Figure 2:
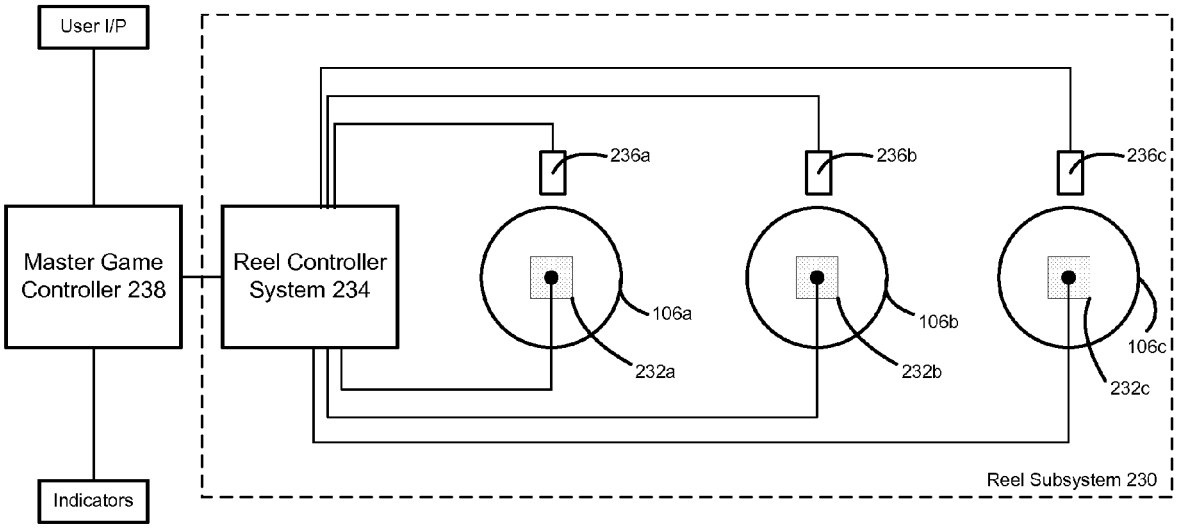
FIG. 2 shows a reel subsystem of an electromechanical wager-based gaming machine including three reels and a reel controller system.

In gaming machine 100 shown, the master game controller determines the game outcome and communicates the game outcome to a separate reel controller system which spins stops the reels to achieve a displayed outcome according to the game outcome sent by the master game controller. FIG. 2 shows the reel subsystem 230 of the gaming machine 100 of FIG. 1B. In particular, FIG. 2 shows three reels 106*a-c* with their individual stepper motors 232*a-c*. Stepper motors 232*a-c* are controlled by a reel controller system 234. The reel controller system 234 sends output signals to each of the stepper motors 232*a-c* that control the rotation of their respective reel 106*a-c*. Each reel 106*a-c* is monitored by a reel position sensor 236*a-c*. Such sensors may be optical sensors or other sensors that can determine the rotational position of a reel as it is spinning. The position sensors 236*a-c* are connected to the reel controller system so that the reel controller system receives feedback regarding the positions of the reels 106*a-c* at any time. The reel control system 234 is also connected to master game controller 238.

Figure 3:
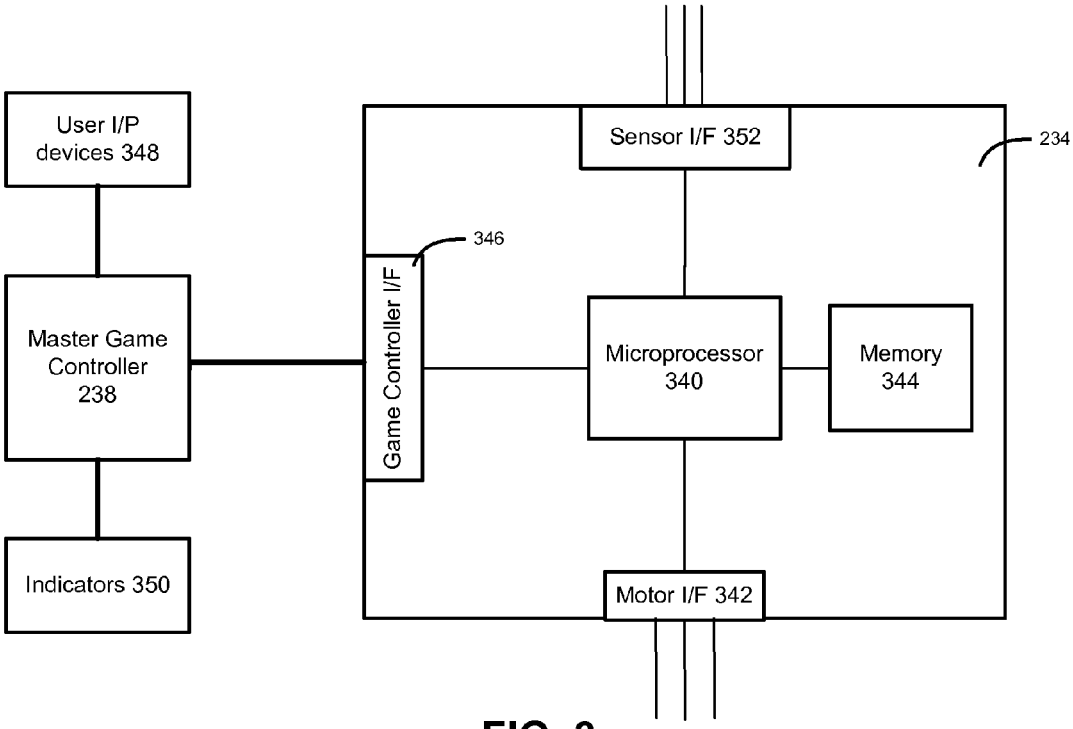
FIG. 3 shows a more detailed view of the reel controller system of FIG. 2.

FIG. 3 shows a more detailed view of the reel controller system 234 of FIG. 2. In particular, FIG. 3 shows a reel controller system that may be embodied in a single integrated circuit. In other embodiments, a reel controller system may be comprised of multiple integrated circuits that may be mounted on a Printed Circuit Board (PCB), or may be separately mounted. For example, separate controllers may be provided for each reel, with communication between controllers to coordinate reel spinning. Thus, a reel controller system may include multiple controllers. FIG. 3 shows reel control system 234 as being separate from a master game controller 238. However, in other examples the reel control system may be combined with the master game controller or other circuits in a single unit.

The reel controller system 234 includes a microprocessor 340 that is in communication with motor interface circuits 342. The microprocessor 340 provides an output to the motor interface circuits 342 which cause the motor interface circuits 342 to send appropriate signals to motors 232*a-c* to control the motors. The output provided by the microprocessor 340 may include predetermined profiles that stepper motors can follow in order to achieve a desired display result. Such predetermined profiles may be selected by the microprocessor 340 from various stored profiles. The microprocessor 340 is in communication with a memory 344 that stores one or more profiles. The memory is generally a nonvolatile memory, such as an EPROM memory that maintains data when power is removed. The microprocessor may also contain one or more memories (e.g. RAM) and in some embodiments, the microprocessor and the memory are on the same chip. While all reel spinning may be controlled by selecting the appropriate profile from various stored profiles, this requires the storage of a large number of profiles to cover all possible reel spinning profiles. Such storage uses a considerable amount of storage space which may add to the cost of the reel controller system. An alternative scheme uses a reduced number of profiles stored in memory.

The reel controller system 234 includes a master game controller interface 346. In general, the master game controller 238 determines a game outcome when a player initiates play. The game outcome is then communicated to the reel controller system 234, which produces an appropriate display output that corresponds to the game outcome by spinning reels and stopping the reels at positions that show the game outcome. The master game controller interface 346 also allows the reel controller system 234 to communicate with other components connected to the master game controller 238. For example, the master game controller 238 may receive various user inputs from user input devices 348, some of which may be relevant to the operation of the reel controller system 234. The master game controller 238 may send an appropriate signal to the reel controller system 234 when a communication is received from such a user input device 348. The reel controller system 234 may also send signals to the master game controller 238 that cause the master game controller 238 to activate one or more indicators 350 in response to such a signal. The indicators 350 may include visual indicators, audio indicators, or other indicators that allows the reel controller system 234 to indicate one or more conditions to a player. In one example, the indicators 350 include individual lights corresponding to each of the reels. While the arrangement of FIG. 3 allows the master game controller 238 to manage user input to the reel controller system 234 and indicators 350 that reflect reel controller signals, in other examples the reel controller system 234 may be directly connected to user input devices 348 and indicators 350 (i.e. without passing through the master gaming controller 238).

Reel controller system 234 includes a sensor interface 352 that receives signals from reel position sensors 236*a-c*. Reel position information is communicated to the microprocessor 340, which can then use the reel position information to make adjustments to the speed and acceleration of an individual reel through the motor interface 342. In particular, the microprocessor 340 can adjust individual reel speeds in order to bring some or all reels into alignment with respect to their final positions so that the reels are in a condition where they can optionally be stopped simultaneously (as opposed to stopping each reel individually, one after another). This reel position feedback allows an individual reel's rotation to be controlled relative to another reel, instead of having each reel controlled by a different profile. In this way, the number of profiles used can be reduced, thus reducing the amount of memory used and the access required to the memory.

Figure 4:
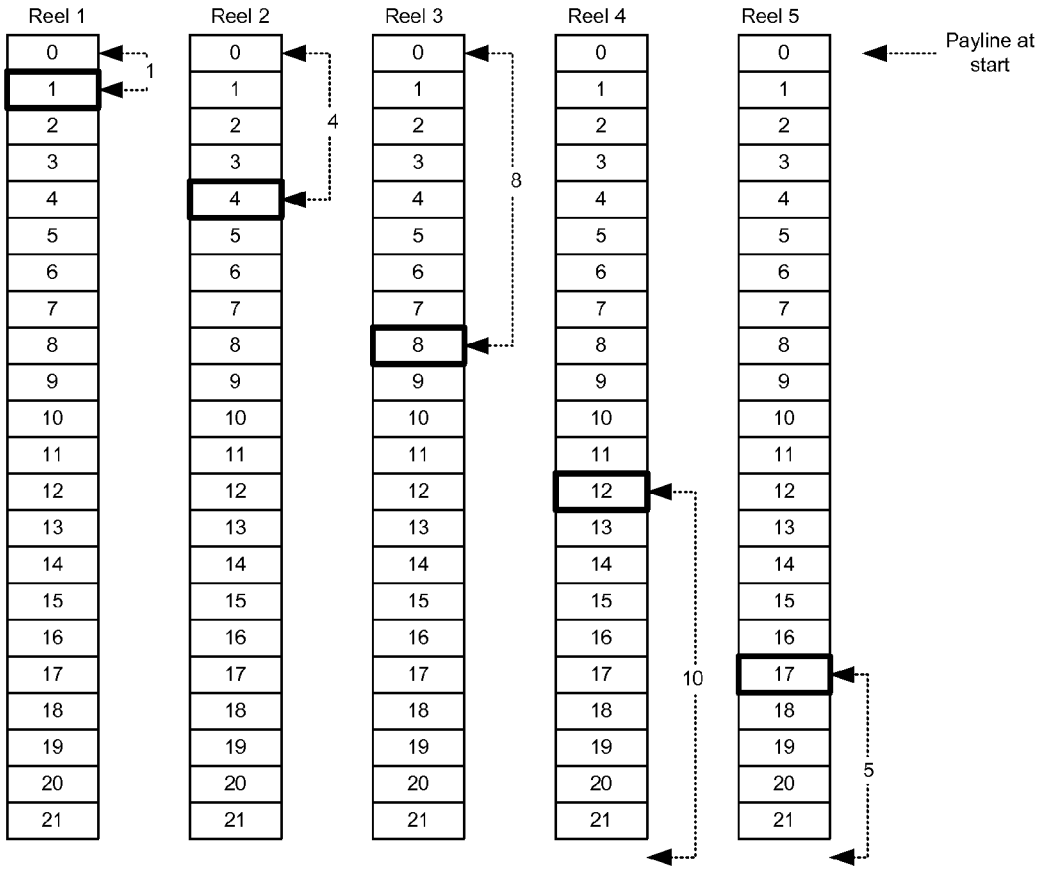
FIG. 4 shows five reels, each having 22 positions, and the differences between present positions and final positions for each reel.

FIG. 4 shows five reels (reel 1-reel 5) having twenty-two positions (0-21) each. While positions are indicated by numbers in this example, reels may have symbols, letters, numbers, etc. on their outer surfaces so that for example a different symbol is shown for each position. In the example illustrated, a game outcome is received by a reel controller system indicating a game outcome of 1, 4, 8, 12, and 17 for reels 1-5 respectively. The reel controller system then spins the reels and stops them so that the game outcome is shown along the payline (this example has a single payline). Thus, the game outcome provided by the master game controller determines the final positions of the reels.

In an embodiment shown in FIG. 4, all reels are brought into an alignment in which their final positions are in a straight line. Since this alignment has relative reel positions that are the same as their final positions, the game outcome can be presented rapidly (i.e. all reels may be spun down at the same rate, while maintaining their relative positions, until all reels are stopped). This allows multiple reels (from two to all reels) to be stopped simultaneously at any time after alignment is achieved, thereby presenting the game outcome in an accelerated fashion compared with a traditional stopping sequence which stops one reel after another. While the deceleration rate to stop each reel may be the same as before, the aligning process allows for a number of reels to be stopped simultaneously, thereby potentially shortening the overall time necessary to stop all reels. In some games, it is desirable to give a player the option to stop the game rapidly. This allows the player to speed up play and initiate another game rapidly. The example of FIG. 4 aligns reels by selecting one reel as the master reel and bringing all other reels (subordinate reels) into alignment with the master reel. All reels are initially at position 0 (i.e. position 0 of each reel is along the payline). The reel with a position difference between its present position and its final position that is closest to the mean position difference is reel 5 (position difference 5). By choosing the reel having a position difference that is closest to the mean in this way, adjustments to other reels to bring them into alignment may be reduced so that alignment is rapidly achieved. It should be noted that in FIG. 4, each reel is circular (as shown in FIG. 2) so that position 21 is adjacent to position 0 and reels may be adjusted in the positive direction or negative direction (i.e. reels may be accelerated or decelerated with respect to the master reel). Therefore, differences between initial and final positions for reels 4 and 5 are shown with respect to the 0 position below position 21 (shown at the top in FIG. 4).

Figure 5:
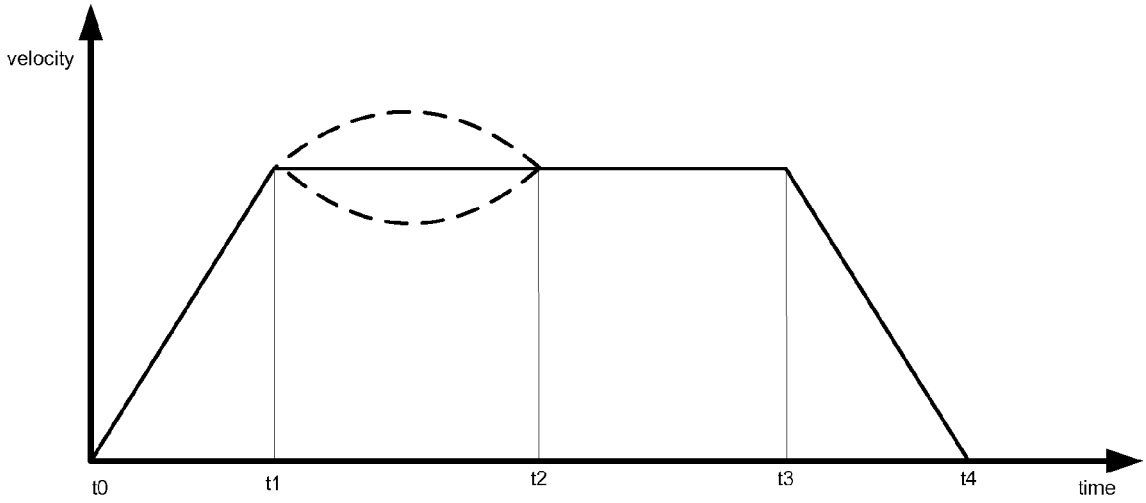
FIG. 5 shows reel velocities for reels that are aligned during an alignment period using position sensor feedback.

FIG. 5 shows reel velocity as a function of time for the reels as they are spun. All reels are accelerated from their initial positions from time t0 to t1. The initial acceleration is generally performed according to a profile that is selected from a group of profiles stored in memory. Such profiles may be stored as lookup tables that determine delays between pulses used in stepper motors. In this example, a profile is selected for the master reel (reel 3), which initiates spinning of reel 3 from position 0 and stopping at position 8. The same profile may be used as a base profile for all other reels. However, spinning of other reels uses feedback to bring the other reels into alignment with the master reel. In particular, FIG. 5 shows an alignment period from t1 to t2 during which certain reels are spun with higher or lower velocities than the master reel (illustrated by dotted lines) until they are brought into alignment. During this time, the reel controller system monitors the position of the master reel and the subordinate reels and makes adjustment to speeds of subordinate reels until they are aligned with the master reel. Subsequently, reels continue to be spun from t2 to t3 at the same speed as the master reel. Then, all reels are brought to a stop during the period from t3 to t4. The time t3 in this example is determined by the profile selected. Spinning down the reels at time t3, according to the selected profile, may be considered default operation. However, in some cases, reels may be stopped earlier than indicated by the selected profile.

Figure 6:
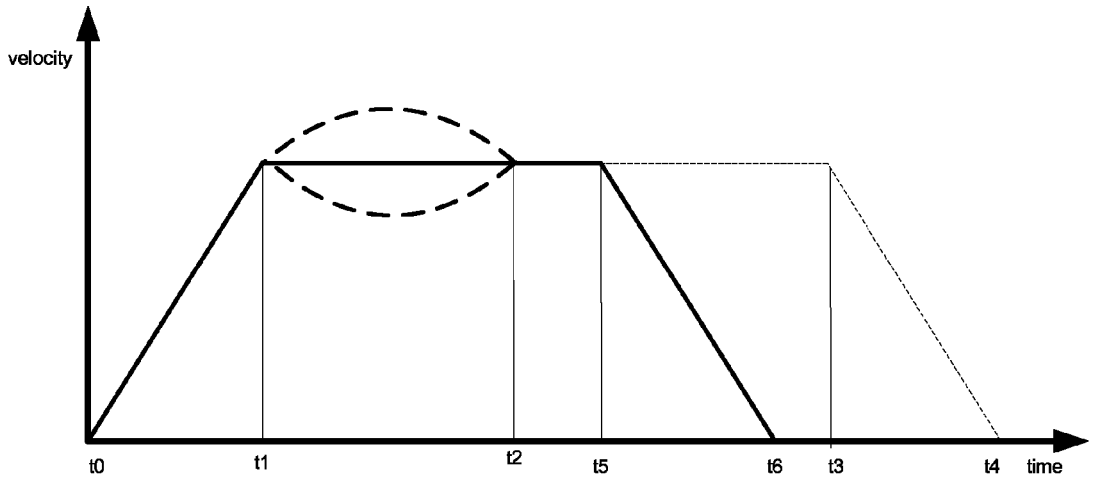
FIG. 6 shows reel velocities for reels that are aligned and subsequently stopped due to a player's input.

FIG. 6 shows a profile for reels that are spun according to the same profile as before. However, at time t5 (prior to default time t3), an input is received by the reel controller that causes the reel controller to stop the reels. The reels are spun down (decelerated) from time t5 to t6 and thus the game is completed in a shorter period of time than the default period (i.e. t6 is before t4). It should be noted that the rate at which the reels are spun down (i.e. the period from t5 to t6) is the same as the default rate (t3 to t4) because all reels are already aligned in their final relative positions and just need to be brought to a stop. No additional adjustment is needed. Typically the input to the reel controller that causes such early stopping is a player input, such as the player pressing the play button when reels are already in motion. However, other inputs may also cause such early termination. For example, an indication that of a security violation (e.g. a door open sensor, power fluctuation, or other input) may cause such early stopping.

Figure 7:
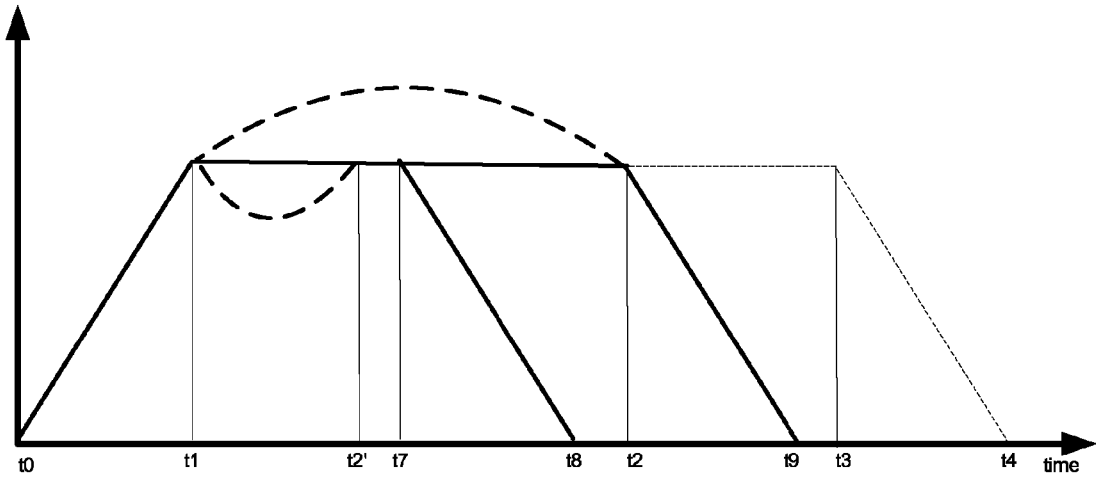
FIG. 7 shows reel velocities for reels that are aligned at different times, with reels stopped due to a player's input prior to alignment of all reels.

While FIG. 6 shows the case where all reels are aligned at the same time (t2) and an input is received by the reel controller after all reels are aligned (after t2), in some cases reels may be aligned at different times and an input may be received before all reels are aligned. FIG. 7 shows the case where reels are aligned at different times. As before, the time when all reels are aligned is designated by t2. However, one reel is aligned with the reference reel at an earlier time t2'. Subsequently, at time t7, an input is received by the reel controller indicating that reels should be stopped. All reels that are aligned at time t7 are stopped (between t7 and t8). Subsequently, at time t2, when remaining reels are aligned, the remaining reels are stopped (between t2 and t9). This subsequent stopping of the remaining reels may occur without any additional input to the reel controller. In other examples, additional reels may be stopped as they become aligned with the master reel. The master reel is not stopped until the last of the subordinate reels is brought into alignment because the reference reel is needed to provide feedback to adjust subordinate reels. Where an input is received by the reel controller before any subordinate reel is brought into alignment, reels may subsequently be stopped as they become aligned.

FIGS. 5-7 show examples where a user input to stop reels spinning (reel slam) is received prior to stopping any reel. However, this is not always the case. Reels may be stopped over a period of time and a user input may be received from a user after one or more reels have already been stopped. In this case, any remaining unstopped reels are stopped in response to the user input. This may allow a user to rapidly end a game when it becomes apparent that the game outcome is not what the player was hoping for.

Figure 8:
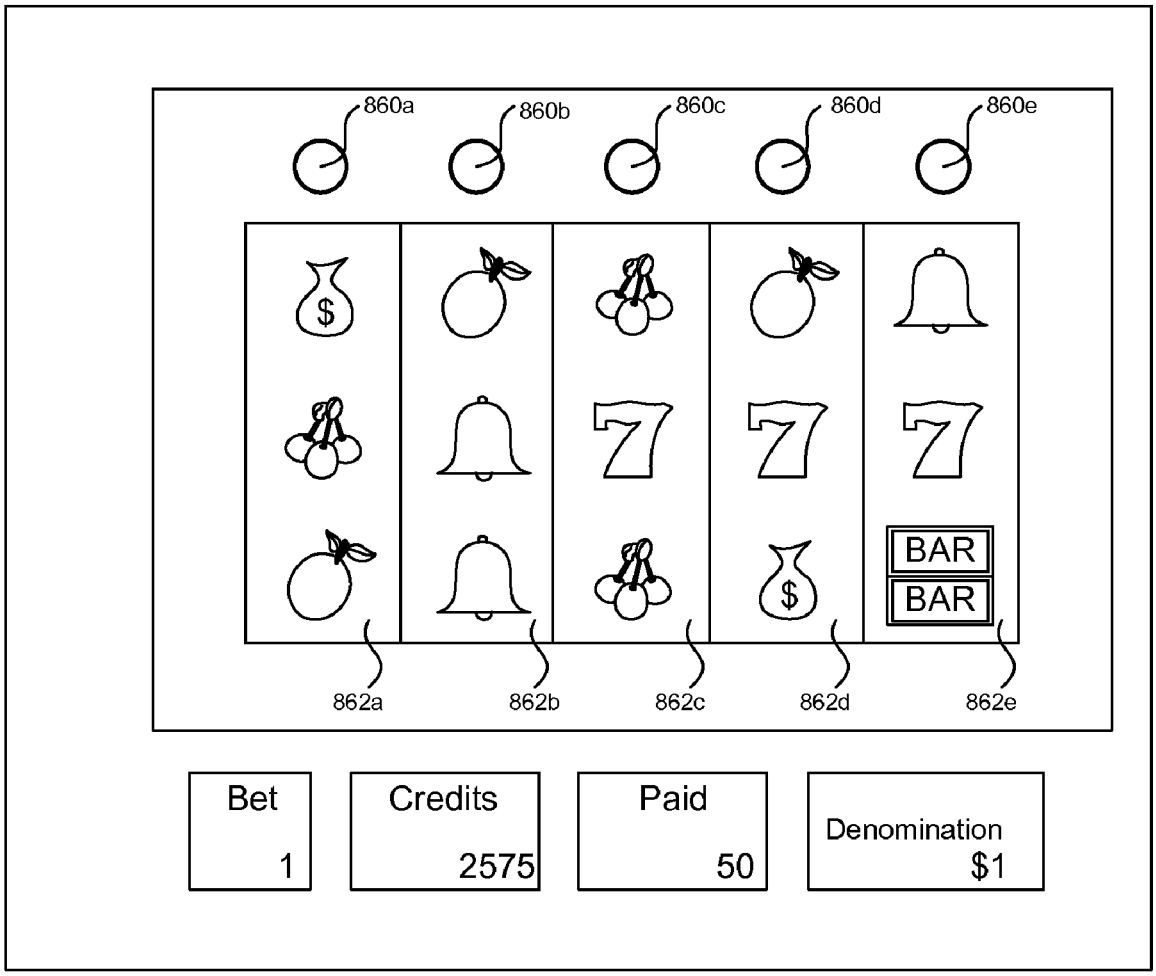
FIG. 8 shows the display of an electromechanical wager-based gaming machine that includes individual indicator lights for each reel to indicate when the reel is aligned with a reference reel.

In some examples, a player is provided with an indicator that a particular reel is aligned with the master reel. FIG. 8 shows an example of a display that includes individual indicator lights 860*a-e* for each reel 862*a-e* to indicate when each reel is in alignment with the master reel. In this example, a light over each reel shows when the reel is aligned. An indicator light may indicate alignment in different ways. For example, an indicator light may turn on when the reel is aligned, or may flash on and off during alignment and become continuously illuminated when the reel is aligned. The master reel may be indicated by a particular light output (e.g. different color, flashing light or some other output that is unique to the master reel). Visual indicators such as lights may be used in combination with other indicators such as sounds that indicate alignment. For example, different tones may indicate alignment of different reels.

While some of the above examples show all reels stopping at the same time, this is not always desirable. In some cases, it may be desirable to have reels stop in a different pattern. For example, reels may stop in a sequence with regular intervals between stopping of individual reels. In some cases, such a stopping pattern may be selected by a player so that reels stop in a way that is most pleasing to the player. In other examples, a pattern may be chosen automatically. For example, different patterns may be used at different times so that play appears less repetitive to the player and the player's interest in the game is maintained. Where a particular pattern of reel stopping is desired, reels are not aligned to their final positions, but instead are aligned with some offset from their final positions to provide a time difference when they are stopped. Thus, a stopping pattern may be established by aligning reels with positions that are offset from their final relative positions, the offsets determining the differences in stopping times.

Figure 9:
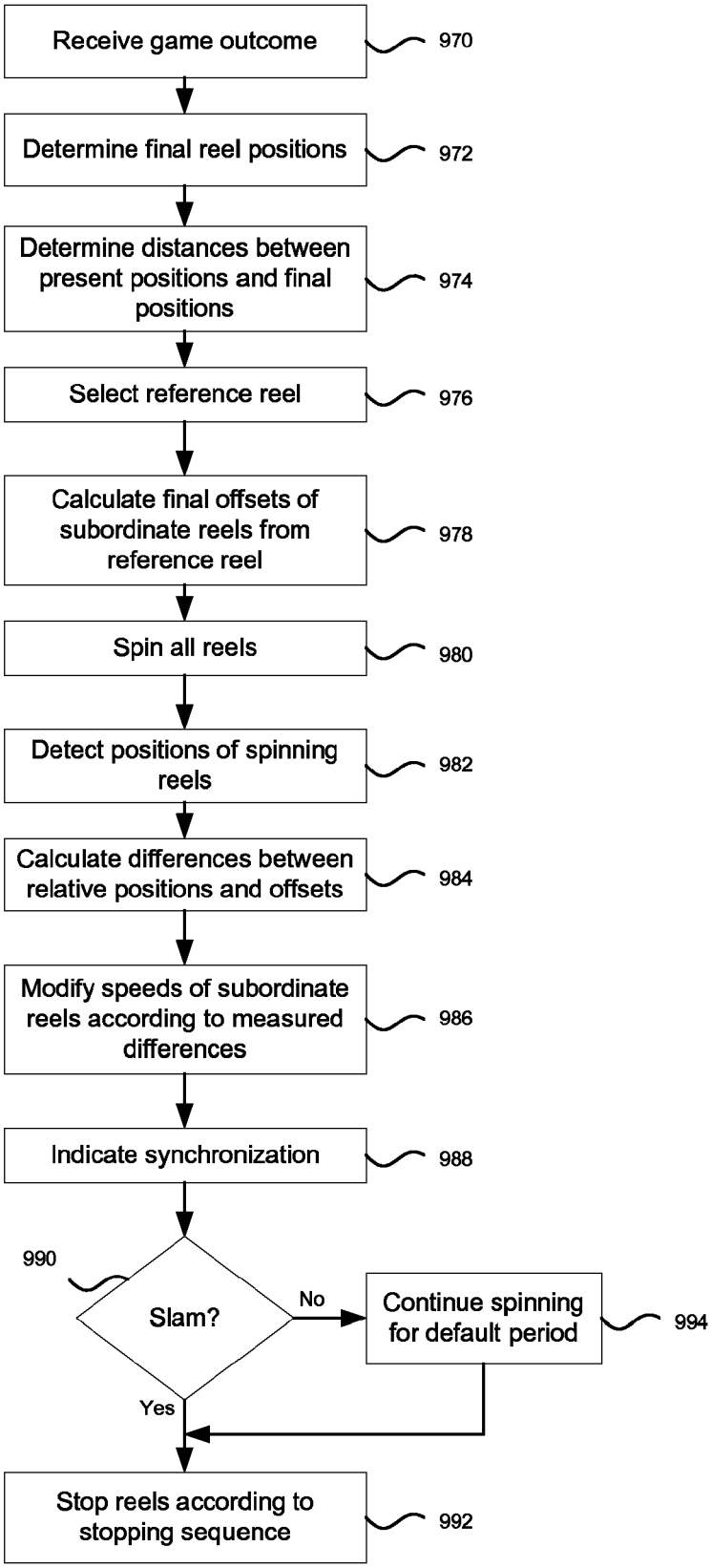
FIG. 9 shows a process for spinning and stopping reels of an electromechanical wager-based gaming machine.

FIG. 9 shows a method of spinning and stopping reels according to an embodiment of the present invention. A game outcome is received 970 by the reel controller system from the master game controller. The reel controller then determines the final reel positions 972 needed to reflect the game outcome and determines the distance between present positions of the reels and their desired final positions 974. A reference reel is selected 976, for example the reel that has a position difference between its present and final position that is closest to the mean of the position differences of all the reels may be chosen. Offsets for subordinate reels are then calculated 978. These offsets may provide some differences between reel positions when they are aligned and their final positions and thus provide some time differences when reels are stopped. Reels are then spun 980 using a predetermined profile for the reference reel. As reels are spinning, positions of spinning reels are detected 982 and relative positions of reels are compared with their previously calculated offsets 984. Speeds of subordinate reels are then modified according to the measured position differences 986. Some reels may be spun faster than the reference reel, while some reels may be spun slower than the reference reel 988. Alignment may be indicated for each reel as it is brought into alignment (synchronization) with the reference reel. Alternatively, alignment may be indicated for all reels by a single indicator without any individual indicators. If an input from a player indicates that reels should be stopped (reel slam? 990) then reels are stopped according to their stopping sequence as determined by their offsets 992. If no such input is received, then reels continue to spin for a default period of time 994 and are then stopped 992. While FIG. 9 shows an indication of synchronization 998 occurring before detecting a user's slam input 990, these events may not occur in the order shown. In particular, synchronization may occur for different reels at different times, either before or after a slam input from a player. In the case where a user input is received prior to alignment, the reel controller system may stop reels as they become aligned as described above, or may wait to stop reels in a predetermined pattern. In other examples, a player may selectively stop reels while allowing other reels to continue spinning. Thus, both synchronization indication and slamming may be performed on a reel-by-reel basis or for all reels together.

Although the foregoing present invention has been described in detail by way of illustration and example for purposes of clarity and understanding, it will be recognized that the above described present invention may be embodied in numerous other specific variations and embodiments without departing from the spirit or essential characteristics of the present invention. Certain changes and modifications may be practiced, and it is understood that the present invention is not to be limited by the foregoing details, but rather is to be defined by the scope of the appended claims.

What is claimed is:

1. A method of controlling a plurality of reels of an electromechanical wager-based gaming machine comprising:

selecting a reference reel from among the plurality of reels;

determining an offset between the final reel position of the reference reel and the final reel position of each other reel;

spinning the plurality of reels, the reference reel spun according to a predetermined profile, the predetermined profile selected to stop the selected reel at its final position;

sensing positions of each of the plurality of reels during spinning; and adjusting reel speeds of each of the other reels relative to the reference reel to align the other reels with the reference reel according to their determined offsets from the reference reel such that the position of each other reel with respect to the reference reel is equal to the determined offset and such that the other reels stop at the same time as the reference reel.

2. The method of claim 1 further comprising stopping the plurality of reels in response to an input from a player while reels are spinning.

3. The method of claim 1 wherein, subsequent to the adjusting of the reel speeds, the reels are spun for a period of time with the reels aligned according to their determined offsets from the reference reel.

4. The method of claim 3, further comprising indicating, using one or more visual indicators, when the other reels are aligned with the reference reel.

5. The method of claim 4, further comprising indicating, for each other reel and using a visual indicator specific to each other reel, when the other reel is aligned with the reference reel.

6. An electromechanical wager-based gaming machine comprising:

a plurality of reels, including a reference reel and subordinate reels, that are rotated by a plurality of motors;

a plurality of sensors that sense positions of the reels as the reels are rotated;

a motor control system that receives inputs from the plurality of sensors and provides outputs that control the plurality of motors to:

align the subordinate reels with the reference reel while the reels are rotating by adjusting speeds of the subordinate reels according to measured positional differences between the subordinate reels and the reference reel as indicated by the plurality of position sensors, and stop the reels in a predetermined stopping pattern; and a memory that is communicatively connected to the motor control system, the memory storing the predetermined stopping pattern and one or more alternative stopping patterns.

7. The electromechanical wager-based gaming machine of claim 6 further comprising a player input device in communication with the motor control system, the motor control system configured to stop the reels in response to an input received from the player input device.

8. The electromechanical wager-based gaming machine of claim 6 further comprising a plurality of indicators, each indicator associated with one of the reels, wherein the motor control system is configured to control each indicator to indicate whether the associated reel is aligned with the reference reel.

9. The electromechanical wager-based gaming machine of claim 6 further comprising instructions stored on a computer-readable, non-volatile storage medium that, when executed, select the reference reel.

10. The electromechanical wager-based gaming machine of claim 9 wherein the reference reel is selected to minimize alignment required to align subordinate reels.

11. A method of controlling a plurality of reels of an electromechanical wager-based gaming machine comprising:

selecting a reference reel from among the plurality of reels;

determining an offset between the final reel position of the reference reel and the final reel position of each other reel;

spinning the plurality of reels, the reference reel spun according to a predetermined profile, the predetermined profile selected to stop the selected reel at its final position;

sensing positions of each of the plurality of reels during spinning; and adjusting reel speeds of each of the other reels relative to the reference reel to align the other reels with the reference reel such that each other reel's position relative to the reference reel after alignment is equal to the determined offset for the other reel plus an additional offset, the additional offsets providing a time delay between when the reference reel stops and when the other reel stops, wherein the time delays result in the reels stopping according to a predetermined pattern.

12. The method of claim 11 further comprising stopping the plurality of reels in response to an input from a player while reels are spinning.

13. The method of claim 11 wherein the predetermined pattern is selected by a player from a menu of predetermined patterns.

14. The method of claim 11 wherein the predetermined pattern is randomly selected from a set of predetermined patterns so that the stopping pattern varies from reel spin to reel spin.

15. The method of claim 11 wherein, subsequent to the adjusting reel speeds, the reels are spun for a period of time with the reels aligned according to their determined offsets from the reference reel plus their respective additional offsets.

16. The method of claim 11, further comprising indicating, using one or more visual indicators, when the other reels are aligned with the reference reel.

17. The method of claim 11, further comprising indicating, for each other reel and using a visual indicator specific to each other reel, when the other reel is aligned with the reference reel.

* * * * *